US008104414B2

(12) United States Patent
Stutznäcker et al.

(10) Patent No.: US 8,104,414 B2
(45) Date of Patent: Jan. 31, 2012

(54) APPARATUS AND METHOD FOR PRODUCING LARGE STITCHED PRODUCTS

(75) Inventors: Klaus Stutznäcker, Frechen (DE); Christian Sturm, Krefeld (DE)

(73) Assignee: Nahmaschinenfrabrick Emil Stutznacker GmbH & Co. KG, Cologne (DE)

( * ) Notice: Subject to any disclaimer, the term of this patent is extended or adjusted under 35 U.S.C. 154(b) by 743 days.

(21) Appl. No.: 11/988,816

(22) PCT Filed: Apr. 27, 2006

(86) PCT No.: PCT/EP2006/003917

§ 371 (c)(1),
(2), (4) Date: Oct. 17, 2008

(87) PCT Pub. No.: WO2007/009516

PCT Pub. Date: Jan. 25, 2007

(65) Prior Publication Data

US 2009/0050040 A1 Feb. 26, 2009

(30) Foreign Application Priority Data

Jul. 15, 2005 (DE) ..... 10 2005 033 751
Aug. 9, 2005 (DE) ..... 10 2005 037 439

(51) Int. Cl.
*D05B 11/00* (2006.01)
*D05B 35/10* (2006.01)

(52) U.S. Cl. ..... 112/475.08; 112/2.1; 112/306

(58) Field of Classification Search ..... 112/10, 112/303–307, 341, 102, 117–119, 470.03, 112/470.31, 470.32, 470.36, 475.08, 318
See application file for complete search history.

(56) References Cited

U.S. PATENT DOCUMENTS

| | | | | |
|---|---|---|---|---|
| 2,803,205 | A | 8/1957 | Solow | |
| 2,968,856 | A * | 1/1961 | Allen | 26/51.5 |
| 3,757,710 | A * | 9/1973 | Landoni | 112/118 |
| 4,501,208 | A * | 2/1985 | Landoni | 112/118 |
| 5,305,099 | A * | 4/1994 | Morcos | 348/88 |
| 5,895,535 | A * | 4/1999 | Bentz | 156/64 |
| 6,158,366 | A * | 12/2000 | Codos | 112/117 |
| 6,209,469 | B1 * | 4/2001 | Burton et al. | 112/475.06 |
| 6,776,109 | B2 * | 8/2004 | Segars et al. | 112/80.23 |

FOREIGN PATENT DOCUMENTS

| | | |
|---|---|---|
| JP | 03 206164 | 9/1991 |
| WO | WO 02/079559 A2 | 10/2002 |

* cited by examiner

*Primary Examiner* — Ismael Izaguirre
(74) *Attorney, Agent, or Firm* — John Wilson Jones; Jones & Smith, LLP

(57) ABSTRACT

An apparatus for producing large stitched products has a multiple needle stitching unit, a storage device, and a processing station. The multiple needle stitching unit has a large number of stitching elements and a guide device which is arranged in the region of the stitching elements and movable in relation to the stitching elements in a direction substantially perpendicular to the conveying direction of the stitched product. Between the multiple needle stitching unit and the processing station is a device for compensating for an annular offset of the stitched product between an output of the guide device and an input of the processing station.

20 Claims, 4 Drawing Sheets

APPARATUS AND METHOD FOR PRODUCING LARGE STITCHED PRODUCTS

Figure 1:
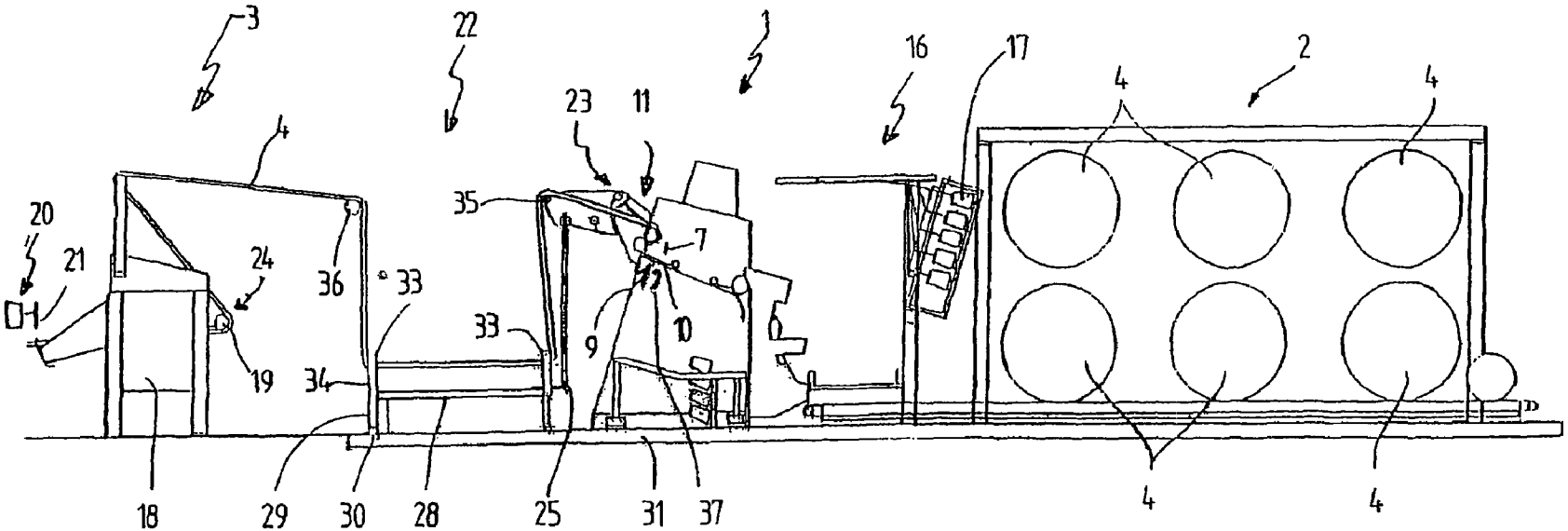

The invention relates to an apparatus for producing large stitched products, especially multi-layered stitched products, preferably rectangular mattress panels, said apparatus consisting of a multiple-needle stitching unit, preferably a multiple needle chain stitch sewing machine, a storage device for the layers of the product to be stitched which is connected upstream of the multiple needle stitching unit, and a processing station which is connected downstream of the multiple needle stitching unit, for stitched products, wherein the multiple needle stitching unit has a large number of stitching elements, especially needles and oppositely arranged hooks, each of which cooperating with a needle, and a guide device for the products to be stitched, which guide device is arranged in the region of the stitching elements and can be moved in relation to the stitching elements in a direction substantially perpendicular to the conveying direction of the stitched products, and wherein the processing station which is connected downstream is configured especially as a cutting device and/or a winder device, by means of which the stitched products are cut and/or wound at least in the conveying direction. The invention further relates to a method for producing large and especially multi-layered stitched products, preferably rectangular mattress panels, in which method the product to be stitched is fed to a multiple needle stitching unit, preferably a multiple needle chain stitch sewing machine, and is stitched within said multiple needle stitching unit in such a way that the product to be stitched is arranged in a guide device and is moved in relation to a large number of stitching elements, especially needles and oppositely arranged hooks, each of which cooperating with a needle, before the stitched product is fed to a processing station which is connected downstream of a multiple needle stitching unit and in which the stitched product is preferably cut and/or wound at least in the conveying direction.

From prior art apparatus for the production of large, especially multi-layered stitched products, preferably rectangular mattress panels, are known. The document DE 103 54 348 B1 for instance discloses such an apparatus which includes as a multiple needle stitching unit a multiple needle chain stitch sewing machine. Connected upstream of the multiple needle chain stitch sewing machine is a storage device for individual layers of the product to be stitched which includes a conveyor belt that is arranged within a frame which rests on rails running transversely to the conveying direction of the conveyor belt and which is movable transversely to the conveying direction of the conveyor belt, the mobility being limited corresponding to a transverse mobility of a conveyor device which is a constituent part of the multiple needle chain stitch sewing machine. Via this conveyor device the product to be stitched together, which normally consists of several layers, is reciprocally moved relative to the stitching elements of the multiple needle chain stitch sewing machine, namely the needles arranged on a needle bar and the hooks arranged on a hook bar, in order to stitch particular patterns into the layers of the stitched product or into the stitched product. During this operation it is necessary that the stitched product is additionally conveyed in two opposite directions within the multiple needle chain stitch sewing machine.

Connected downstream of the multiple needle chain stitch sewing machine is a processing station which in the apparatus according to DE 103 54 348 B4 is configured as a winder station and in which the finished stitched product is wound.

A further multiple needle chain stitch sewing machine is known from DE 101 25 108 A1. In this pre-known multiple needle chain stitch sewing machine several layers of the product to be stitched are again withdrawn from a storage device for layers of the product to be stitched which is connected upstream of the multiple needle chain stitch sewing machine and are fed to the multiple needle chain stitch sewing machine, where the individual layers of the product to be stitched are stitched together. From this document it is known that the multiple needle chain stitch sewing machine includes a guide device for the product to be stitched, which guide device is arranged in the region of the stitching elements and is movable relative to the stitching elements in a direction substantially perpendicular to the conveying direction of the stitched product. At the same time the stitched product may be conveyed both in the conveying direction from the storage device for layers of the product to be stitched and in the opposite direction, in order to be able to stitch a plurality of sewing patterns.

The above-described apparatus have generally proved themselves as suitable for the production of large, especially multi-layered stitched products, especially rectangular mattress panels. Especially during a final cutting operation of rectangular mattress panels from the stitched product leaving the multiple needle stitching unit it can be noticed that a high cutting accuracy especially in the longitudinal direction of the stitched product, i.e. in the conveying direction but also perpendicular to it, is possible only with an increased controlling. It is required for this purpose that for instance the finished stitched product is clamped and aligned in the region of the longitudinal edges, in order to be able to make cuts in the longitudinal direction of the stitched product with a high degree of parallelism and precision relative to the sewing pattern. These working steps lead to the fact that the substantially continuous sewing process is decelerated if not even interrupted in the region of the cutting device. In this connection it has been observed that especially the aligning of the stitched product is time-consuming on one hand and cannot be performed with the required precision on the other hand. Due to the relative movement of the guide device with respect to the stitching elements and also to the downstream processing station the stitched material normally arrives at the processing station under an angle deviating from the conveying direction and has to be aligned in said processing station, as far as precise cuts are to be performed in the longitudinal direction of the stitched product.

In a similar manner a deviation of the stitched product from the conveying direction is caused during the change of the stitching direction in dependence of the movement of the guide device. This deviation results in stitched seams running slightly diagonally. Due to the overlay of these two deviations within the multiple needle stitching unit and in the processing station the defective production of the stitched material increases, resulting in a possible high reject of products not ready for sale.

Starting from the above-described prior art it is an object of the present invention to further develop an apparatus or a method of this generic type in such a way that the finished stitched product runs into the processing station substantially without or with only a very slight deviation from the conveying direction or between the stitching elements in the case of stitching counter to the conveying direction.

In an apparatus according to the invention the solution of this object provides that between the multiple needle stitching unit and the processing station a device for compensating of an angular offset of the stitched product between an output of the guide device and an input of the processing station is arranged.

Accordingly, in the apparatus according to the invention a device for compensating for an angular offset of the stitched product between the output of the guide device and the input of the processing station is provided. Through this device which is connected to the guide device in such a way that each movement of the guide device is transmitted also to the device, it is possible in a simple way to align the stitched product in the direction of the conveying sense from a possible angularly offset orientation, so that the stitched product runs into the processing station in a direction corresponding to the conveying direction, the stitched product in this processing station being trimmed for instance on its margins, where these cuts may be performed with a high precision parallel to the previously stitched seams, by the apparatus according to the invention.

Preferably, the device is connected to a guide device. By this connection the precision of the arrival of the stitched product in the processing station is improved. In this embodiment it turned out as advantageous to provide for an elastic connection between the device and the guide device, in order to reduce forces, especially on the points of change of direction at the end of the guide device. Spring elements such as pressure springs and/or elastomers may be used as an elastic connection. In addition to the elastic connectors a damping element is advantageous which reduces the impact load between the device and the guide device.

A further development of the apparatus according to the invention provides that the device includes a frame in which at least three, preferably four mutually parallel extending guide rollers which are preferably supported for rotation are arranged for a substantially U-shaped guiding of the stitched product, and that the frame is supported for pivoting about a fulcrum relative to the conveying direction of the stitched product. Here the fulcrum is perpendicularly aligned, and according to a further feature of the invention it turned out as advantageous to arrange this fulcrum substantially perpendicularly under a guide roller which is supported for rotation in a part of the frame that faces the processing station.

By this embodiment lateral deviations of the stitched product from a target line may be compensated for.

According to a further embodiment of the apparatus according to the invention it is provided that the device is connected to the guide device by a mechanical coupling. Preferably, the mechanical coupling includes two rod-shaped elements which are oriented in such a way as to mutually extend in a V-shape, said elements being fixed to the frame in a junction point and being arranged on the guide device with their opposite ends. The rod-shaped elements may be screw-fixed for instance with the free ends thereof to the external sides of the guide device.

An alternative embodiment provides that the device is connected to the guide device through an electronic coupling in which the relative movements of the guide device with respect to the stitching elements are transmitted as data to a drive which moves the device analogously to the relative movements of the guide device. The data transmission may be performed in a wired or wireless fashion, where the drive of the device may be arranged for instance in a rotary bearing which forms the fulcrum and consists of a drive motor which includes a pinion that meshes with a crown gear having internal teeth, said crown gear being arranged on the frame and said drive motor being arranged in the rotary bearing.

Additionally, the connection between the device and the guide device can be formed to be mechanically and/or electronically adjustable, especially in dependence of a processing result in the processing station. By this further development the result of the processing in the processing station can be used as a parameter of the setting of the device relative to the guide device. If for instance the longitudinal edge cuts of the stitched product to be made parallel to the longitudinal edges or the stitched seams there formed are not performed with the required precision, the setting of the device relative to the guide device may be made mechanically, for instance through a setting screw, in order to align the arrival of the stitched product in such a way that the stitched product runs into the processing station with high precision in the desired conveying direction.

To this end, the processing station preferably includes a data storage with desired data for the result of the processing. On the basis of these desired data the actual data are obtained and compared to the desired data. If during this operation a fault is detected, e.g. an excessive precision deviation, the data from the comparison between the desired data and the actual data may be used as parameters for the adjustment of the connection between the device and the guide device in a dependent fashion. The adjustment then takes place for instance through an adjustment drive, e.g. in the form of a stepping motor or a pneumatically or hydraulically operable linear motor which is addressed or activated through the data storage and which performs the required relative movement of the device with respect to the guide device. By constantly monitoring the result of the processing a continuous improvement of the setting of the device relative to the guide device may then be made. This procedure allows a quick adaptation of the device for different layers of the product to be stitched, of which the conveying is effected differently through different values of friction.

Finally, it is provided in the apparatus according to the invention that the processing station includes a cutting device which cuts the stitched product transversely, especially at right angles to the conveying direction, so that after the cutting of the stitched product in the conveying or longitudinal direction an additional cut transversely to the conveying direction is performed, for instance for producing a mattress panel.

For the solution of the above-mentioned problem provisions are made in a method according to the invention for the stitched product being aligned for its exact position in a device arranged between the multiple needle stitching unit and the processing station, for the compensation of an angular offset of the stitched product between an output of the guide device and an input of the processing station with regard to its arrival in the processing station, especially for the cutting in the conveying direction and/or the winding of the stitched product.

According to a further development of the method according to the invention it is provided that the stitched product is fed to a frame of the device in which at least three, preferably four mutually parallel extending guide rollers which are supported for rotation are arranged, and that the stitched product is passed through the device substantially in a U-shaped fashion, with the stitched product being pivoted in dependence of the relative movement of the guide device to the stitching elements together with the frame about a fulcrum relative to the conveying direction of the stitched product.

According to a further feature of the method according to the invention it is provided that the device is connected to the guide device through an electronic coupling, in which the relative movements of the guide device to the stitching elements are transmitted as data to a drive which moves the device analogously to the relative movements of the guide device.

Finally, the method according to the invention provides that the stitched product is fed to a cutting device in which the stitched product is cut transversely and especially at right angles to the conveying direction.

Figure 2:
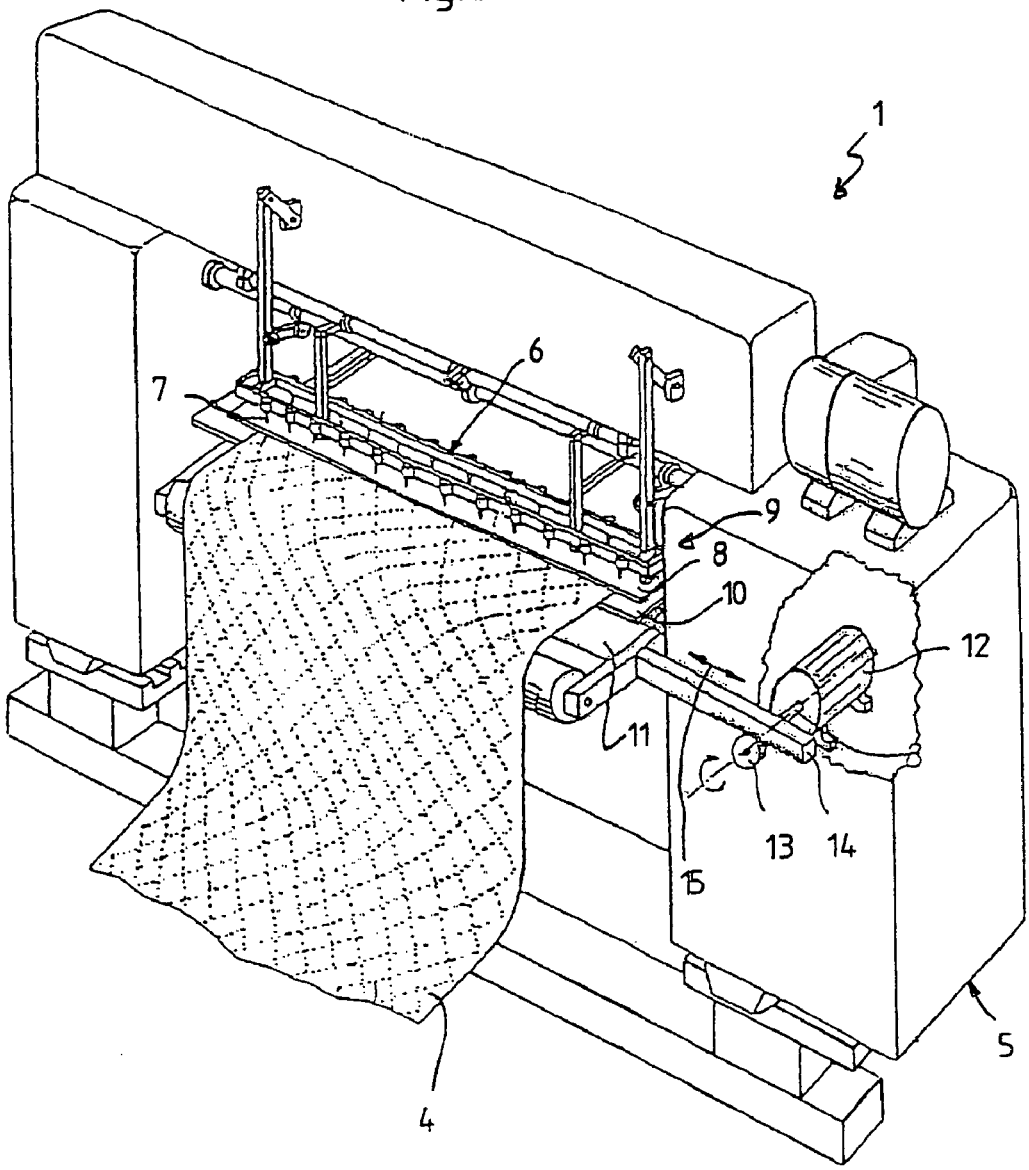
Figure 3:
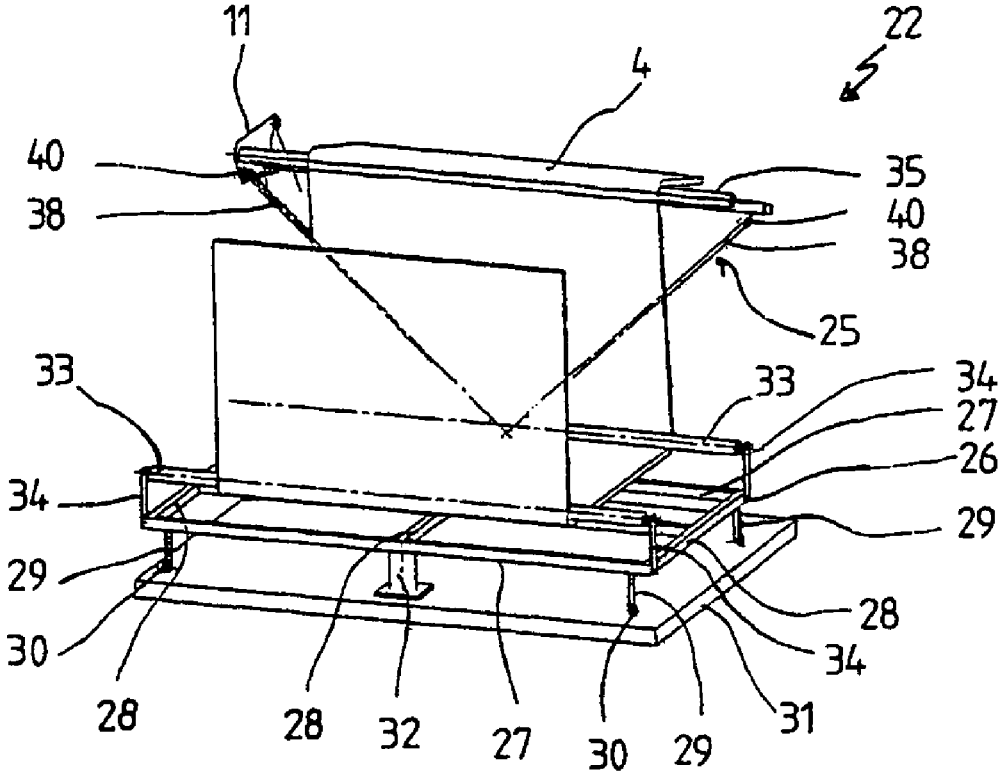
Figure 4:
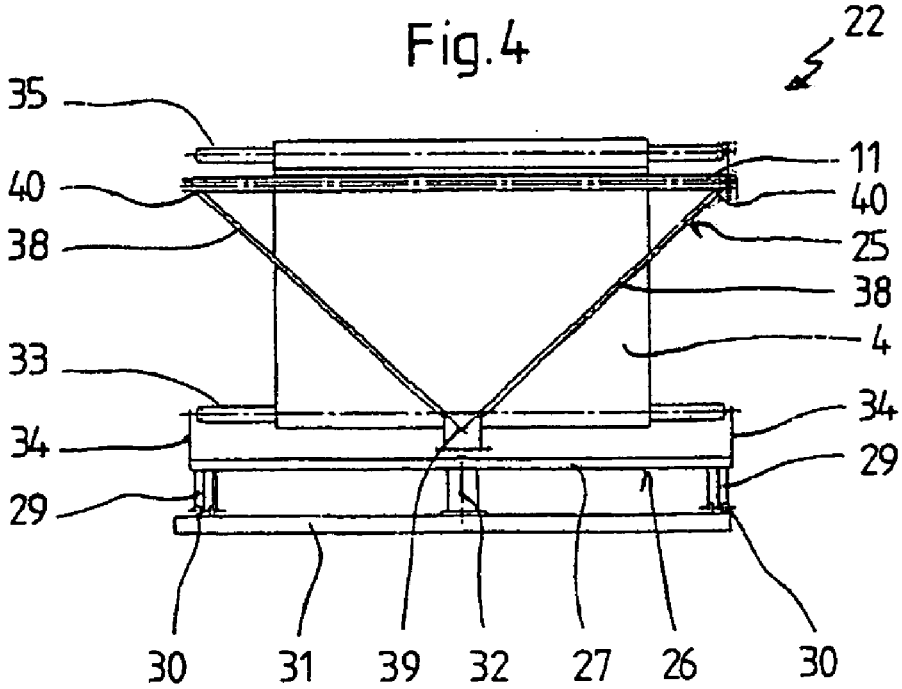
Figure 5:
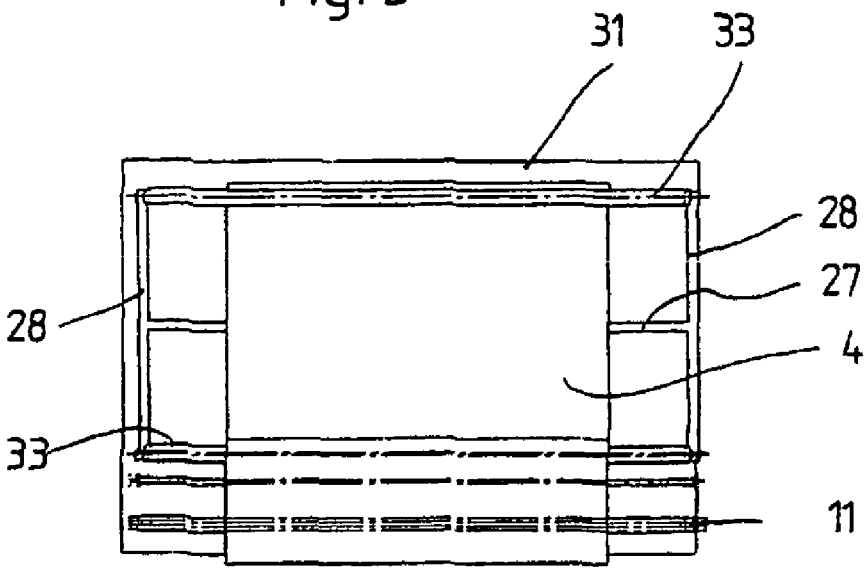

Further features and advantages of the invention will become apparent from the following description of the enclosed drawing showing a preferred embodiment of an apparatus according to the invention. In the drawing it is shown by:

FIG. 1 an apparatus for the production of large stitched products in a lateral view;

FIG. 2 a multiple needle stitching unit according to FIG. 1 in a perspective view;

FIG. 3 a device for compensating for an angular offset of the stitched product in a perspective view;

FIG. 4 the device according to FIG. 3 in a front view;

FIG. 5 the device according to the FIGS. 3 and 4 in a top view; and

Figure 6:
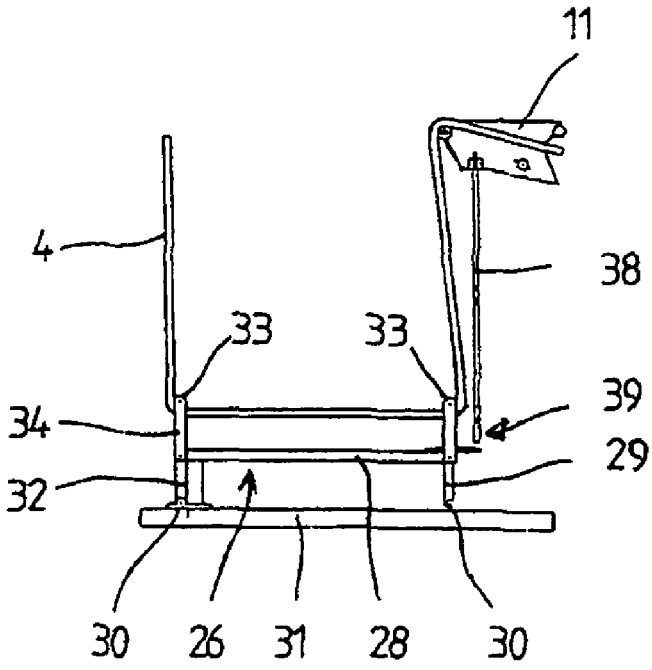

FIG. 6 the device according to the FIGS. 3 to 5 in a lateral view.

An apparatus as shown in FIG. 1, for the production of large stitched products, namely rectangular mattress panels, consists of a multiple needle stitching unit 1 configured as a multiple needle chain stitch sewing machine, a storage device 2 for layers of the product to be stitched which is connected upstream of the multiple needle sewing unit 1, and a processing station 3 for stitched products 4 which is connected downstream of the multiple needle stitching unit 1. The multiple needle stitching unit 1 is shown in FIG. 2 in a perspective view and consists of a machine frame 5 having a needle row 6 consisting of a plurality of needles 7 in the upper part thereof. Reference number 8 designates a conventional pressure foot. Arranged on the opposite side of the needle row 6 and not further shown in FIG. 2 is a row of hooks 37, said row of hooks 37 comprising a plurality of hooks 37, each of which cooperating with a needle 7. Below the layers of the stitched product 4 which are combined in the stitching area 9 there is a needle plate 10 or a stitching table. The stitching table 10 serves as a support for the stitched product 4.

The stitched product 4 has several layers of the product to be stitched which are stored in the storage device 2 for layers of the product to be stitched.

For example, a layer of the product to be stitched may consist of an outer fabric, especially mattress drill or the like, which outer fabric is stitched together with an elastic layer of a foamed material and a non-elastic lower layer.

The multiple needle stitching unit 1 further includes a support which is designed as a guide device 11 which is connected downstream of the needle plate 10 in the conveying direction and which is movable transversely to the conveying direction of the stitched product 4 corresponding to a double arrow 15, through a drive motor 12 having a pinion 13 and a toothed rack 14 meshing with the pinion 13. Through the guide device 11 the stitched product 4 is moved relative to the needles 7 and the hooks 37 transversely to the conveying direction of the stitched product 4, in order to be able to stitch various sewing patterns into the stitched product 4.

Moreover, the multiple needle sewing unit 1 includes conveyor means which are not further shown, by which the stitched product 4 may be moved in two directions perpendicular to the orientation of the needle row 6, so that the stitched product 4 is movable both in and against the conveying direction.

The storage device 2 for layers of the product to be stitched shown in FIG. 2 includes several rolls 4 with layers of the product to be stitched which are withdrawn from the rolls 4 and supplied to the multiple needle stitching unit 1. Additionally there is arranged between the storage device 2 for layers of the product to be stitched and the multiple needle stitching unit 1 a thread storage device 16 with a plurality of thread bobbins 17 for paying off the thread needed for the stitching operation.

The downstream processing station 3 includes a housing 18 where the stitched product arrives in a condition stretched over a roll 19. Inside the housing 18 at least two circular disk-shaped cutting tools (not further shown) are arranged, by which the stitched product 4 is trimmed along its longitudinal edges which extend in the conveying direction. The stitched product 4 which is cut in this way then reaches an area of a cutting device 20 which again includes a circular disk-shaped cutting tool 21, by which the stitched product 4 that has previously been trimmed along the edges extending in the longitudinal direction is transversely cut into individual sections which then have the dimensions of individual mattress panel cover sheets. To this end, the cutting device 20 is movable relative to the surface of the stitched product 4. As an alternative to the above-described circular disk-shaped cutting tools 21 also multiple bow cutters may be used.

Between the multiple needle stitching unit 1 and the processing station 3 a device 22 for compensating an angular offset of the stitched product 4 between an output 23 of the guide device 11 and an input 24 of the processing station 3 is arranged. The device 22 is connected to the guide device 11 of the multiple needle stitching unit 1 through a mechanical coupling 25.

In the FIGS. 3 to 6 the device 22 is illustrated in detail.

The device 22 includes a frame 26 which consists of three longitudinal supports 27 aligned transversely to the conveying direction and three cross beams 28 which extend at right angles to the longitudinal supports 27 and hence in the conveying direction. Accordingly, the frame 26 is formed in a ladder shape. On the frame 26, substantially in the region of the connecting points between the outer cross beams 28 and the longitudinal supports 27, supports 29 are arranged which carry roller bodies 30 on the free ends thereof, which roller bodies 30 rest on a bottom 31.

The frame 26 further takes support on a rotary bearing 32 which is arranged on one side fixed for rotation with the bottom 31 and on the other side twistable with the frame 26 in the region of the junction point between the central cross beam 28 and the longitudinal support 27 facing the processing station 3.

Above the frame 26 two guide rollers 33 are arranged which are supported for rotation in brackets 34, said guide rollers 33 running parallel to the longitudinal supports 27, and one guide roller 33 being arranged perpendicularly above the rotary bearing 32.

A third guide roller 35 is arranged above the guide roller 33 facing the multiple needle stitching unit 1 and is supported for rotation in the guide device 11.

A forth guide roller 36 which is not further illustrated in the FIGS. 3 to 6 and which also forms a constituent part of the device 22 is arranged above the rotary bearing 32 and serves for redirecting the stitched product 4 towards the processing station 3. This guide roller 36 is arranged relative to the guide roller 33 that is arranged below it in such a way that the stitched product 4 is oriented to run substantially perpendicularly. Furthermore, the fixedly arranged guide roller 36 runs at right angles to the conveying direction of the stitched product 4 in the processing station 3. Alternatively, the guide roller 36 may be arranged perpendicularly above the guide roller 33 which is arranged in the region of the rotary bearing 32.

The device 22 is connected to the guide device 11 through a mechanical coupling 25, so that the relative movements of the guide device 11 to the needles 7 and the hooks 37 (see FIG. 1) are immediately and directly transmitted to the device 22, whereby the device 22 is pivotally moved about the rotary bearing 32 corresponding to the movement of the guide device 11. During this operation the roller bodies 30 are moved against the bottom 31.

The mechanical coupling 25 consists of two rod-shaped elements 38 which are oriented so as to mutually extend in a V-shape, which elements 38 are fixed in a junction point 39 to the frame 26 and are arranged with their opposite ends 40 on the guide device 11. Here the junction point 39 is arranged in the region above the longitudinal support 27, which extends parallel and at distance to the longitudinal support 27, which latter mentioned support 27 is connected to the rotary bearing 32.

The elements 38 forming the mechanical coupling 25 are arranged in the junction point 39 for a limited pivotal movement with respect to the frame 26, so that lateral movements of the guide device 11 on one side lead to the fact that the frame 26 is pivoted about the rotary bearing 32 and on the other side the frame is supported by all of the four roller bodies 30 against the bottom 31.

With the above-described apparatus it is possible to feed large, especially multi-layered stitched products in a very precisely aligned arrangement to a processing station 3, by compensating through the device 22 for lateral deviations of the stitched product 4 from the desired line of the stitched product 4 which is required for performing cuts. This compensation may be effected both in the case of deviations which are predetermined by a movement of the guide device 11 at right angles to the conveying direction and in the case of deviations which occur during a forward and backward stitching operation in the multiple needle stitching unit 1. Accordingly, the device 22 not only serves for feeding the stitched product 4 to the processing station 3 in a very precise arrangement but also for providing for a compensation of the conveying direction which possibly deviates from the precise conveying direction of already stitched products 4 to the multiple needle sewing unit 1.

To this end, the stitched product 4 is fed to the multiple needle stitching unit 1 and is stitched in the multiple needle stitching unit 1 in such a way that the stitched product 4 is arranged in a guide device and is moved relative to a plurality of sewing elements, namely needles 7 and hooks 3, before the stitched product 4 is fed to processing station 3 connected downstream of the multiple needle stitching unit 1 for already stitched products 4, in which the stitched product 4 is cut and/or wound at least in the conveying direction. For the precise alignment of the stitched product 4 in the processing station 3 the stitched product 4 is exactly aligned in its position in a device 22 arranged between the multiple needle stitching unit 1 and the processing station 3 for compensating for an angular offset of the stitched product 4 between the output 23 of the guide device 11 and the input 24 of the processing station 3 with regard to its arrival in the processing station 3 for the cutting operation in the conveying direction and/or the winding of the stitched product 4.

The invention claimed is:

1. An apparatus for producing multi-layered stitched products, said apparatus consisting of a multiple needle stitching unit, a storage device for layers of the product to be stitched which is connected upstream of the multiple needle stitching unit, and a processing station for stitched products which is connected downstream of the multiple needle stitching unit, wherein the multiple needle stitching unit includes a plurality of stitching elements, each of which cooperating with a needle, and a guide device for the product to be stitched which is arranged in the region of the stitching elements and is movable relative to the stitching elements in a direction substantially perpendicular to the conveying direction of the stitched product, by which the stitched product is cut and/or wound at least in the conveying direction, characterized in that between the multiple needle stitching unit and the processing station a device is arranged for compensating for an angular offset of the stitched product between an output of the guide device and an input of the processing station.

2. The apparatus of claim 1, wherein the device is connected to the guide device.

3. The apparatus of claim 2, wherein the device is connected to the guide device through a mechanical coupling.

4. The apparatus of claim 3, wherein the mechanical coupling includes two rod-shaped elements which are oriented so as to mutually extend in a V-shape, wherein the elements are fixed to the frame of the device in a junction point and are arranged with the opposite ends on the guide device.

5. The apparatus of claim 2, wherein the device is connected to the guide device through an elastic connection.

6. The apparatus of claim 5, wherein the elastic connection is designed as a spring member.

7. The apparatus of claim 5, wherein the elastic connection includes at least one damping element.

8. The apparatus of claim 2, wherein the device is connected to the guide device through an electronic coupling, in which the relative movements of the guide device to the stitching elements are transmitted as data to a drive which moves the device analogously to the relative movements of the guide device.

9. The apparatus of claim 2, wherein the connection between the device and the guide device is formed to be mechanically and/or electronically adjustable.

10. The apparatus of claim 9, wherein the processing station includes a data storage with desired data for the result of the processing and adjusts the connection between the device and the guide device in dependence of a comparison of the desired data with the obtained actual data.

11. The apparatus of claim 1, wherein the device includes a frame in which at least three mutually parallel running guide rollers are arranged for a substantially U-shaped guiding of the stitched product and that the frame is pivotable about a fulcrum relative to the conveying direction of the stitched product.

12. The apparatus of claim 11, wherein the fulcrum is arranged substantially perpendicularly below a guide roller which is rotatably supported in a region of the frame facing the processing station.

13. The apparatus of claim 11, wherein the guide rollers are rotatably supported.

14. The apparatus of claim 1, wherein the processing station includes a cutting device which cuts the stitched product transversely to the conveying direction.

15. The apparatus of claim 1, wherein the multiple needle stitching unit is a multiple needle chain stitch sewing machine.

16. The apparatus of claim 1, wherein the downstream processing station is a cutting device and/or winder device.

17. A method of producing multi-layered stitched products, comprising feeding a stitched product into a multiple needle stitching unit and stitching multiple layers of the stitched product into the multiple needle stitching unit, such that the stitched product is positioned in a guide device and moves relative to a plurality of stitching elements, each of which cooperating with a needle, feeding the multi-layered stitched product to a processing station connected downstream of the multiple needle stitching unit, in which processing station the multi-layered stitched product is cut and/or wound at least in the conveying direction, wherein the multi-layered stitched product is positioned in a device between the multiple needle stitching unit and the processing station for compensating for an angular offset of the multi-layered stitched product between an output of the guide device and an input of the processing station with regard to its arrival in the processing station.

18. The method of claim 17, comprising feeding the multi-layered stitched product to a frame of the device, in which frame at least three mutually parallel running and guide rollers are arranged, and passing the multi-layered stitched product through the device substantially in a U-shape, wherein the stitched product is pivoted relative to the conveying direction of the stitched product about a fulcrum, together with the frame in dependence of the relative movement of the guide device to the stitching elements.

19. The method of claim 17, comprising connecting the device to the guide device through an electronic coupling, in which the relative movements of the guide device to the stitching elements are transmitted as data to a drive which moves the device analogously to the relative movements of the guide device.

20. The method of claim 17, comprising feeding the multi-layered stitched product to a cutting device, in which the stitched product is cut transversely to the conveying direction.

* * * * *